US007534136B2

(12) United States Patent
Bova

(10) Patent No.: US 7,534,136 B2
(45) Date of Patent: May 19, 2009

(54) OVERHEAD DEVICE FOR MANAGING ELECTRICAL APPLIANCES

(76) Inventor: Richard E. Bova, 117 Chestnut St., Port Allegany, PA (US) 16743

( * ) Notice: Subject to any disclaimer, the term of this patent is extended or adjusted under 35 U.S.C. 154(b) by 0 days.

(21) Appl. No.: 11/745,755

(22) Filed: May 8, 2007

(65) Prior Publication Data

US 2008/0280459 A1 Nov. 13, 2008

(51) Int. Cl.
*H01R 13/60* (2006.01)

(52) U.S. Cl. ..... 439/537; 248/317; 439/535

(58) Field of Classification Search ..... 439/537, 439/535, 719; 248/49, 317, 51, 52, 176.2
See application file for complete search history.

(56) References Cited

U.S. PATENT DOCUMENTS

| | | | | |
|---|---|---|---|---|
| 4,094,076 | A | 6/1978 | Baslow | |
| 4,159,773 | A | 7/1979 | Losenno | |
| 4,219,178 | A | 8/1980 | Assion | |
| 4,461,439 | A | 7/1984 | Rose | |
| 4,566,666 | A | 1/1986 | Meska et al. | |
| 5,124,532 | A | 6/1992 | Hafey et al. | |
| 5,372,514 | A | 12/1994 | Odemer et al. | |
| 5,485,931 | A | 1/1996 | Barr, Jr. | |
| 5,547,393 | A | 8/1996 | Jansen | |
| 5,577,819 | A | 11/1996 | Olsen | |
| 5,590,475 | A | 1/1997 | Andis | |
| 5,743,415 | A | 4/1998 | Smart | |
| 5,875,794 | A | 3/1999 | Ekman | |
| 5,917,694 | A | 6/1999 | Denny | |
| 6,126,011 | A | 10/2000 | Ullmann et al. | |
| 6,164,582 | A | 12/2000 | Vara | |
| 6,179,665 | B1 | 1/2001 | Rossman et al. | |
| 6,305,388 | B1 | 10/2001 | Zeller | |
| 6,331,121 | B1 | 12/2001 | Raeford, Sr. | |
| 6,457,686 | B1 * | 10/2002 | Hill | 248/176.1 |
| 6,581,890 | B2 * | 6/2003 | Johnson et al. | 248/161 |
| 6,591,952 | B1 | 7/2003 | Randall | |
| 6,769,554 | B1 | 8/2004 | Udofiah | |
| 6,805,314 | B2 | 10/2004 | Hopper | |
| 6,820,755 | B1 | 11/2004 | Ranjit | |
| 6,969,031 | B2 * | 11/2005 | Ugent et al. | 248/125.8 |
| 6,969,275 | B1 | 11/2005 | Brock | |
| 2003/0222069 | A1 | 12/2003 | Sena et al. | |
| 2005/0106935 | A1 | 5/2005 | Pena | |

* cited by examiner

*Primary Examiner*—Tho D Ta
*Assistant Examiner*—Travis Chambers
(74) *Attorney, Agent, or Firm*—Jay M. Schloff; Intellipex PLLC

(57) ABSTRACT

The present invention discloses a device that provides a convenient, safe, attractive method for holding, reaching and managing a plurality of electrical appliances by avoiding the cords getting entangled with each other in a work station. The device comprises a central hub, a plurality of flanges extending outwardly from the central hub and a plurality of electrical receptacles disposed on the central hub. Each flange has a first fastener disposed at an end of the flange and a second fastener disposed on the body of the flange, the first and second fasteners are capable of holding the electrical appliance and looping the electrical cord thereof such that an electrical plug of the electrical appliance is received into the electrical receptacle providing power to the electrical appliance. The device is capable of rotary motion thereby providing access to each electrical appliance.

11 Claims, 3 Drawing Sheets

OVERHEAD DEVICE FOR MANAGING ELECTRICAL APPLIANCES

FIELD OF THE INVENTION

The present invention relates generally to devices for storing and accessing a plurality of electrical appliances and more particularly to an overhead rotatory device for storing and managing a plurality of electrical appliances.

BACKGROUND OF THE INVENTION

At places wherein a plurality of electrical appliances are used, for instance, beauty shops, storage and maintenance of the electrical appliances, such as blow dryers, curling irons, clippers, are unpleasant associated conditions of the workplace. Often the plurality of electrical appliances are restricted to a confined area, therefore these devices are hanged from the hooks by their electrical cords with their electrical plugs connected to the receptacles. When a user switches from using appliance to another, the electrical appliances must be moved, and their electrical cords may become entangled, twisted or at times pulled out from the receptacles. In order to disentangle and maintain the electrical cords involves added time and effort on the part of the user. Further, there is always a possibility of an electrical short circuit happening because of the entangling and manipulation of the electrical cords. Furthermore, the entangling of electrical cords of the electrical appliances increase the possibility of electrical fires in a work zone and also increases the possibility of burns caused by the electrical appliances lying around on surfaces in work zones where the appliances may be touched by a user accidentally.

In order to overcome these problems a number of approaches have been proposed in the past. U.S. Pat. No. 6,969,275 to Brock discloses a cord organizing system for cosmetology tools. The system includes cord retractor mounted on the workstation for retracting the cord of the electrical appliance. A locking grommet cord and slot prevents the movement forces on the electrical appliance during extension and retraction. However, the Brock patent cannot store large number of electrical appliances. Further, the system proposed in the Brock patent is very complex and can only be mounted on the side of wall. Additionally, the presence of cord retractor may cause wear and tear in the cord of the electrical appliance because every time the electrical appliance is used, the cord will be extended and then retracted back. The Brock invention also requires a great amount of effort to pull out the selected electrical appliance because of presence of cord retractor.

US Patent Publication No. 20050106935 to Pena discloses an overhead storage device for plurality of electrical appliances. The device includes a casing that encloses an extension cord system. The casing has slots that allow access to the retractable cords of the electrical appliances. The cord system includes a plurality of spring loaded and ratcheted reels containing cords of electrical appliances. However, the overhead storage device of the Pena patent is complex and, further, the cords are retractable thereby increasing the possibility of the wear and tear of the cords.

Given the state of the prior art, there exists a need for having an overhead device for storing and managing the accessibility of a plurality of electrical appliances. It is desirable to have the overhead device that ensures that the entangling of the electrical cords of the electrical appliances does not happen. It is also desirable that a minimum effort is required while selecting and enabling a particular electrical appliance for use. In addition, it is preferred that the device be configured with minimum configurational complexities in order to reduce the wear and tear in electrical cords. Furthermore, such a device should be simple and easy to use.

SUMMARY OF THE INVENTION

In view of the foregoing disadvantages inherent in the prior arts, the general purpose of the present invention is to provide an overhead device for storing and managing electrical appliances to include all the advantages of the prior art, and to overcome the drawbacks of the inherent therein.

In another aspect, the present invention provides a device for storing and managing a plurality of electrical appliances. The device comprises a central hub comprising a top portion and a bottom portion, a plurality of flanges extending outwardly from the central hub, each flange comprising at least one fastener capable of holding an electrical appliance or the electrical cord of the electrical appliance; and a plurality of electrical receptacles disposed on the central hub. The electrical receptacles are electrically connected to a power source and each electrical receptacle is capable of receiving an electrical plug secured to the electrical cord of the electrical appliance for providing power supply to the electrical appliance.

In yet another aspect, the present invention provides an overhead device for suspending and managing a plurality of electrical appliances. The overhead device comprises: a cylindrical central hub comprising a top portion, and a bottom portion, a plurality of flanges extending outwardly from the central hub, each flange comprising at least one fastener capable of holding an electrical appliance or the electrical cord of the electrical appliance; and a plurality of electrical receptacles disposed on the bottom portion. The electrical receptacles are electrically connected to a power source and each electrical receptacle is capable of receiving an electrical plug secured to the electrical cord of the electrical appliance for providing power supply to the electrical appliance. The central hub is capable of being rotated around a central axis of the central hub thereby providing access to each electrical appliance.

These together with other aspects of the present invention, along with the various features of novelty that characterize the invention, are pointed out with particularity in the claims annexed hereto and forming a part of this disclosure. For a better understanding of the invention, its operating advantages and specific objects attained by its uses, reference should be had to the accompanying drawings and descriptive matter in which there are illustrated exemplary embodiments of the present invention.

BRIEF DESCRIPTION OF THE DRAWINGS

The advantages and features of the present invention will become better understood with reference to the following detailed description and claims taken in conjunction with the accompanying drawings, wherein like elements are identified with like symbols, and in which:

Like reference numerals refer to like parts throughout the description of several views of the drawings.

DETAILED DESCRIPTION OF THE INVENTION

The exemplary embodiments described herein detail for illustrative purposes are subject to many variations in structure and design. It should be emphasized, however, that the present invention is not limited to an overhead device for storing and managing electrical appliances, as shown and described. It is understood that various omissions, substitutions of equivalents are contemplated as circumstances may suggest or render expedient, but is intended to cover the application or implementation without departing from the spirit or scope of the claims of the present invention.

The terms "a" and "an" herein do not denote a limitation of quantity, but rather denote the presence of at least one of the referenced item.

Figure 1:
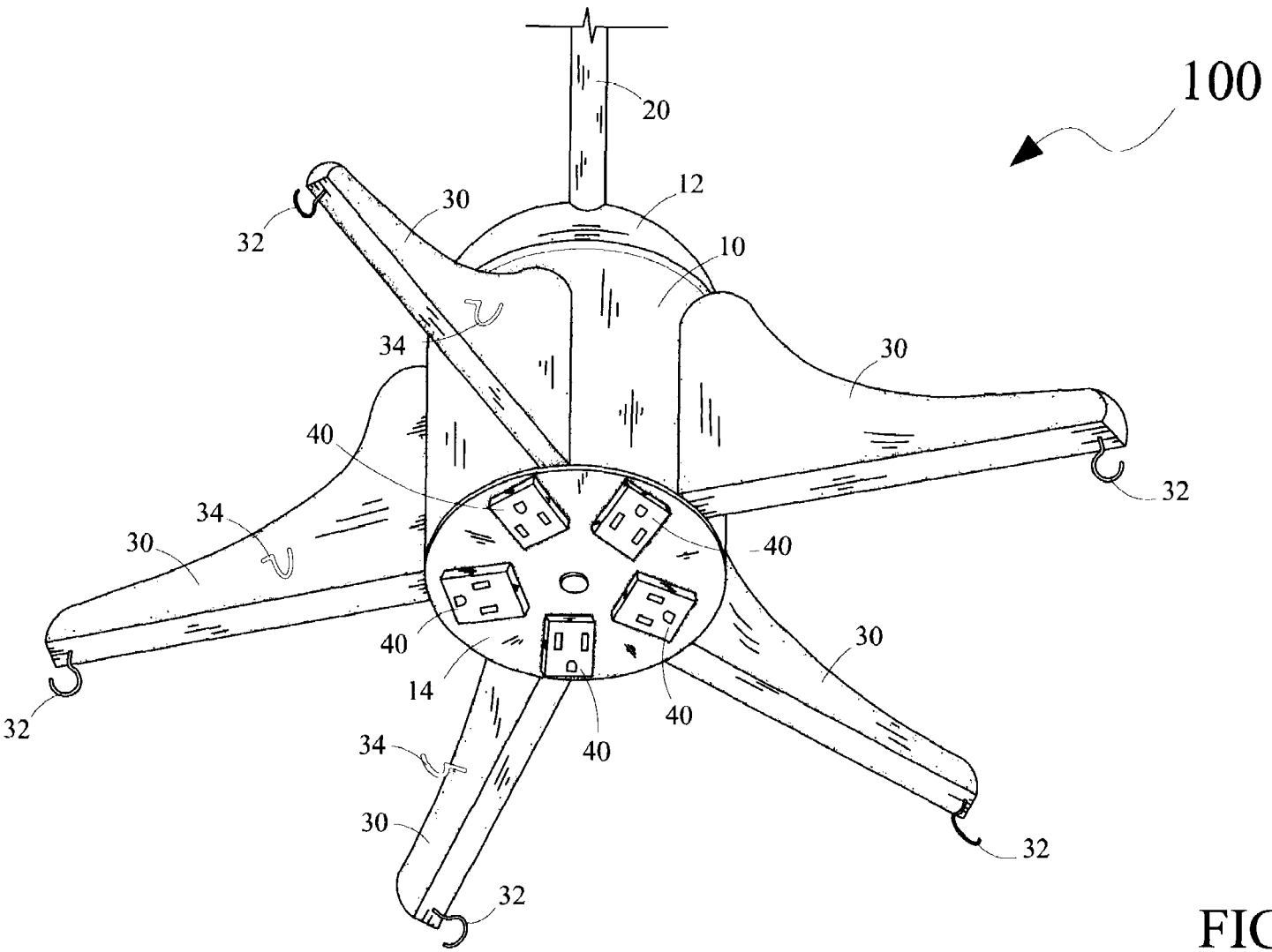
FIG. 1 is a bottom perspective view of an overhead device 100, according to an exemplary embodiment of the present invention.

Referring to FIG. 1, a bottom perspective view of an overhead device 100 is shown. The overhead device 100 comprises a central hub 10 having top portion 12, and a bottom portion 14. The top portion 12 of the central hub 10 is attached to a support 20, thereby making the overhead device 100 suspended vertically downwards from the support 20. The overhead device 100 comprises a plurality of flanges 30 extending outwardly from the central hub 10 and a plurality of electrical receptacles 40 disposed on the central hub 10. In FIG. 1 for the purposes of understanding five flanges 30 are shown, however, the number of flanges may vary depending upon different embodiments and need of the invention. In a preferred embodiment, as shown in FIG. 1, the overhead device comprises a cylindrical central hub 10 with the plurality of flanges 30 extending outwardly from the central hub 10. Each flange 30 comprises a first fastener 32, capable of holding an electrical appliance and a second fastener 34 capable of looping an electrical cord of the electrical appliance, in a manner, such that, an excess electrical cord between the first fastener 32 and the second fastener 34 loops down towards the floor. The first fastener 32 is disposed at an end of the flange 30 away from the central hub 10 and the first fastener 32 is capable of hanging the electrical appliances by hooking into a loop on a body of the electrical appliances. The fastener 32 may include but is not limited to hooks, snaps, loops and clips. The second fastener 34 is a screw hook, and is disposed on the body of the flange 30 closer to the central hub 10. The electrical receptacles 40 are disposed at the bottom portion 14 of the cylindrical central hub 10. The electrical receptacles 40 are electrically connected to a power source (not shown) and each electrical receptacle 40 is capable of receiving an electrical plug secured to the electrical cord of the electrical appliance for providing power supply to the electrical appliances. The number of electrical receptacles 40 defines the maximum number of electrical appliances that may be stored and managed using the overhead device 100 at one time. However, the positioning of the electrical receptacles 40 on the central hub 10 and the number of electrical receptacles 40 are no limitation to the present invention and a person skilled in the art may easily envision a number of different configurations and quantity of the electrical receptacles 40.

The overhead device 100 has the mechanism for providing the power supply to the electrical appliances through the electrical receptacles 40. The overhead device 100 has a rotary mechanism, thereby making it capable of rotating around a central axis of the central hub 10 and hence providing the simultaneous access of the plurality of electrical appliances to a user.

Figure 2:
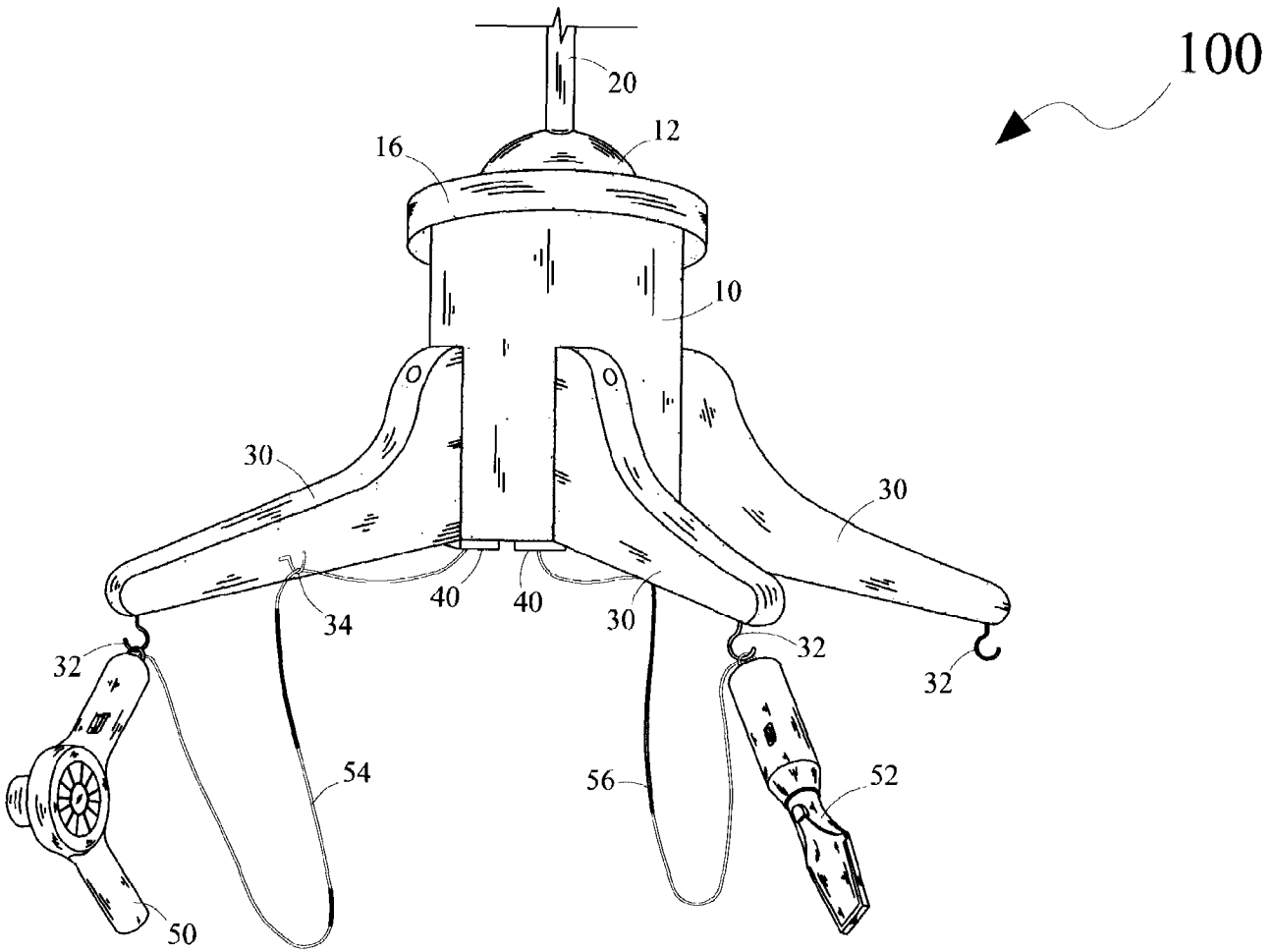
FIG. 2 is a side perspective view of the overhead device 100 for storing and managing electrical appliances, according to an exemplary embodiment of the present invention.

Referring to FIG. 2, a side perspective view of the overhead device 100, for storing and managing electrical appliances 50 and 52 is shown. The overhead device 100 further comprises a rotary mechanism 16, which is mounted on the top portion 12 of the central hub 10. The rotary mechanism 16 provides the round and round motion of the central hub 10 thereby enabling electrical appliances 50, 52 hanging from the overhead device 100, to be accessible to a user. The rotary movement of the overhead device 100 ensures that the cords of the electrical appliances are not tangled with each other, when the user of the overhead device 100 switches from using one electrical appliance to another. The electrical appliances 50 and 52 are hung though the fasteners 32. The electrical plug secured to the electrical cord of the electrical appliance 50 may be plugged in the receptacle 40 for providing power supply to the electrical appliance 50 Once an electrical appliance is accessed by the user, the user can rotate the overhead device 100 by applying a minimum pressure to the overhead device 100, and hence the position of the electrical appliance changes and the user can now access another electrical appliance. For example, the user may first access and then restore the electrical appliance 50 to a hanging position on a flange 30, and thereafter the user may apply little pressure to the overhead device 100 such that the electrical appliance 52 reaches to the position of the electrical appliance 50, hence allowing the user access to the electrical appliance 52. The examples of electrical appliances may include but are not limited to curling irons, blow dryers, clippers, strengtheners, drilling machines, grinding machines and soldering machines.

Figure 3:
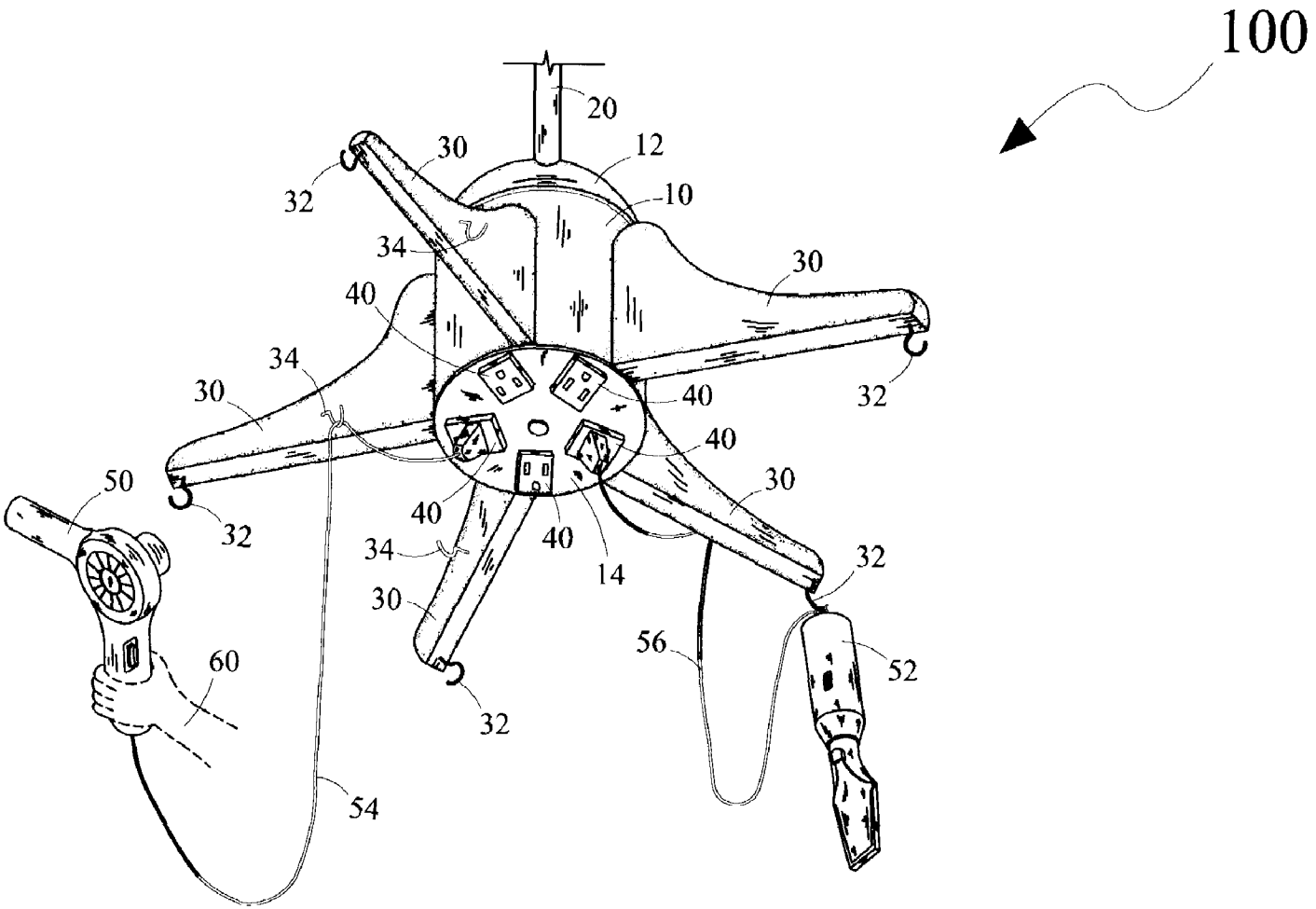
FIG. 3 is a bottom perspective view of the overhead device 100 in an utilized state for storing and managing electrical appliances, according to an exemplary embodiment of the present invention.

Referring next to FIG. 3, a bottom perspective view of the overhead device 100, for storing and managing electrical appliances is illustrated. The electrical appliance 50 is in a working mode and being used by a user 60 (a hand of the user is shown in FIG. 3). The electrical plug of the electrical appliance 50 is plugged in the receptacle 40. The electrical appliance 50 is hanging through the electrical cord 54, which cord 54 is supported by the fastener 34. The excess electrical cord 54 of the electrical appliance 50 loops down towards the floor. The electrical appliance 52 is hanging through the electrical cord 56, which appliance 52 and cord 56 are respectively supported by the second set of fasteners 32 and 34. The excess electrical cord 56 of the electrical appliance 52 loops down towards the floor. The electrical appliance 52 is not in the working mode. Once the user 60 has used the electrical appliance 50, he may refasten it to the fastener 32 and apply a little pressure to the overhead device 100, thereby causing the overhead device 100 to rotate through its rotary mechanism 16 such that the position of the electrical appliance 50 and 52 changes and hence the user may now use the electrical appliance 52.

The overhead device 100 may be made of a material providing sufficient structural integrity to the overhead device 100 and enabling easy rotary motion of the overhead device 100 for providing easy access to each electrical appliance hung from the overhead device 100. Suitable materials for making the overhead device 100 may include but are not limited to stainless steel, wood, and hard plastic.

There is thus provided a device for storing, holding, managing and accessing electrical appliances thereby enabling a user to organize work stations/work zones. The device provides a safe, convenient and attractive way of accessing plurality of electrical appliances. The device may be used in any environment where several electrical appliances have to be used at the same location, for example, in a beauty shop. The device is very easy to operate and increases the efficiency of a user operating the device, thereby making simultaneous and easy access to all the electrical appliances to the user. The device is provided with a rotary mechanism thereby ensuring that the electrical cords of the electrical appliances are not entangled with each other thereby avoiding any short circuit due to entangling of electrical cords and provides fire safety while using the appliances in a work station. The use of the present invention also eliminates the scenario of electrical appliances lying around on work stations and in turn provides safety from burns because of accidental touch to live electrical appliances lying around on work stations. Several electrical appliances may be stored and managed in an efficient manner using this device. Furthermore, the device is not complex and very easy to operate. The present invention may be made available in a variety of configurations envisioned by persons skilled in the art. In one configuration, the present invention may be made ceiling mounted by mounting the support of the overhead device to the ceiling of a room. In another configuration, the overhead device of the present invention may be configured as wall mounted by mounting the support of the overhead device to a wall in a manner, such that, the overhead device hangs towards the floor.

The foregoing descriptions of specific embodiments of the present invention have been presented for purposes of illustration and description. They are not intended to be exhaustive or to limit the invention to the precise forms disclosed, and obviously many modifications and variations are possible in light of the above teachings. The embodiments were chosen and described in order to best explain the principles of the invention and its practical application, to thereby enable others skilled in the art to best utilize the invention and various embodiments with various modifications as are suited to the particular use contemplated. It is understood that various omissions, substitutions of equivalents are contemplated as circumstance may suggest or render expedient, but is intended to cover the application or implementation without departing from the spirit or scope of the claims of the present invention.

What is claimed is:

1. A device for storing and managing a plurality of electrical appliances, the device comprising:

a central hub comprising a top portion and a bottom portion, the top portion being attached to a support, such that, the device is suspended vertically downwards from the support;

a plurality of flanges extending outwardly from the central hub, each flange from the plurality of flanges extending from the top portion to the bottom portion of the central hub, the each flange comprising a first fastener disposed at an end of the each flange away from the central hub, the first fastener capable of hanging an electrical appliance from the plurality of electrical appliances by hooking into a loop on a body of the electrical appliance, and a second fastener disposed on a body of the each flange towards the central hub, the second fastener capable of looping an electrical cord of the electrical appliance; and a plurality of electrical receptacles disposed on the central hub, the plurality of electrical receptacles electrically connected to a power source, each electrical receptacle capable of receiving an electrical plug secured to the electrical cord of the electrical appliance for providing power supply to the electrical appliance, wherein the central hub is capable of being rotated around a central axis of the central hub thereby providing access to each electrical appliance from the plurality of the electrical appliances.

2. The device of claim 1, wherein the plurality of electrical appliances comprises at least one of blow dryers, curling irons, clippers, strengtheners, drill machines, grinding machines, and soldering machines.

3. The device of claim 1, wherein the first fastener comprises at least one of hooks, snaps, loops, and clips and the second fastener is a screw hook.

4. The device of claim 1, wherein the plurality of electrical receptacles is disposed on the bottom portion of the central hub.

5. The device of claim 1, wherein the device is ceiling mounted.

6. The device of claim 1, wherein the device is wall mounted.

7. An overhead device for suspending and managing a plurality of electrical appliances comprising:

a cylindrical central hub comprising a top portion and a bottom portion;

a plurality of flanges extending outwardly from the central hub, each flange from the plurality of flanges extending from the top portion to the bottom portion of the central hub, the each flange comprising a first fastener disposed at an end of the each flange away from the central hub, the first fastener capable of hanging an electrical appliance from the plurality of electrical appliances by hooking into a loop on a body of the electrical appliance, and a second fastener disposed on a body of the each flange towards the central hub, the second fastener capable of looping an electrical cord of the electrical appliance; and a plurality of electrical receptacles disposed on the bottom portion, the plurality of electrical receptacles electrically connected to a power source, each electrical receptacle capable of receiving an electrical plug secured to the electrical cord of the electrical appliance for providing power supply to the electrical appliance, wherein the central hub is capable of being rotated around a central axis of the central hub thereby providing access to each electrical appliance.

8. The overhead device of claim 7, wherein the plurality of electrical appliances comprises at least one of blow dryers, curling irons, clippers, screwdrivers, drill machines, grinding machines, and soldering machines.

9. The overhead device of claim 7, wherein the first fastener comprises at least one of hooks, snaps, loops, and clips and the second fastener comprises a screw hook.

10. The overhead device of claim 7, wherein the overhead device is ceiling mounted.

11. The overhead device of claim 7, wherein the overhead device is wall mounted.

* * * * *